United States Patent [19]

Taylor

[11] 4,351,068

[45] Sep. 28, 1982

[54] PANTY HOSE GARMENTS

[76] Inventor: Dorothy L. Taylor, 25630 Southfield Rd., #201, Southfield, Mich. 48075

[21] Appl. No.: 215,013

[22] Filed: Dec. 10, 1980

[51] Int. Cl.[3] ..... A41B 11/04

[52] U.S. Cl. ..... 2/409

[58] Field of Search ..... 2/409

[56] References Cited

U.S. PATENT DOCUMENTS

| | | | |
|---|---|---|---|
| 957,893 | 5/1910 | Marville | 2/409 |
| 2,000,898 | 5/1935 | Donaldson | 2/409 |
| 3,621,493 | 11/1971 | Krueger | 2/409 |

*Primary Examiner*—Doris L. Troutman

[57] ABSTRACT

A panty hose garment constructed of knitted fabric and incorporating stocking tubes, each having no foot portion, each having leg and upper portion with the upper portions being joined together along a center seam, thus defining the panty portion of the panty hose garment. The footless panty hose garment is provided to enable unrestricted passage of air to the feet of the panty hose wearer.

The point of termination of the stocking tube portion being elastically secured to leg of the wearer by an elastic band, and the elastic band being superimposed over said fabric, secured at the point of termination by chainstitch to prevent raw edges of the fabric from unravelling. The knitted fabric of the panty hose garment enables the panty hose garment to stretch to fit different sizes of wearers and to snugly embrace the portion of the body of the wearer covered by the panty hose garment.

1 Claim, 3 Drawing Figures

FIG. 1
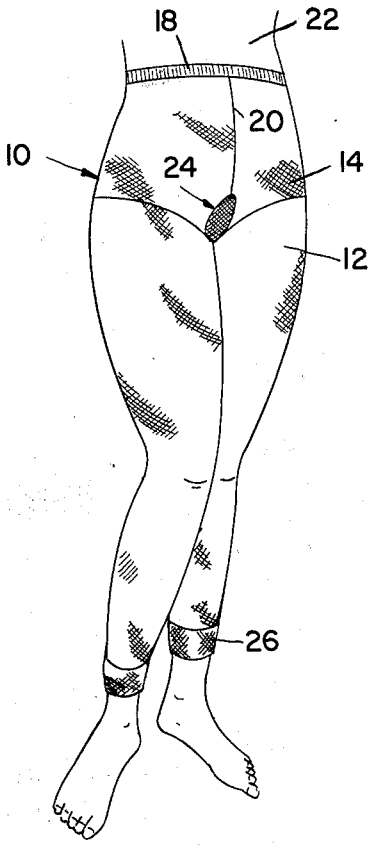
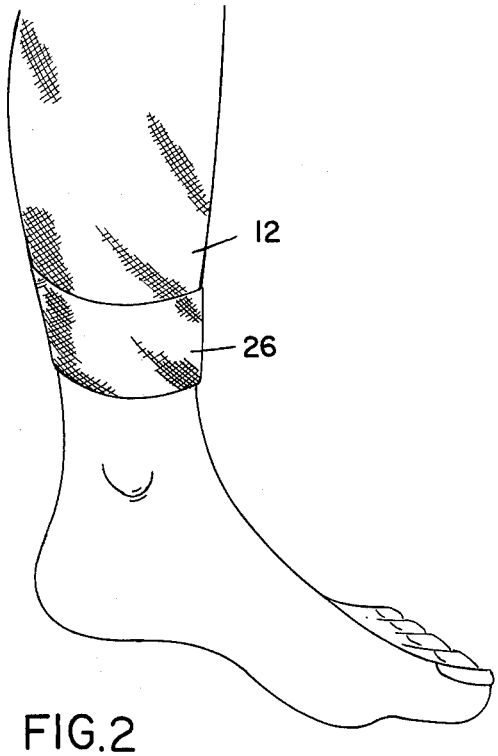
FIG. 2
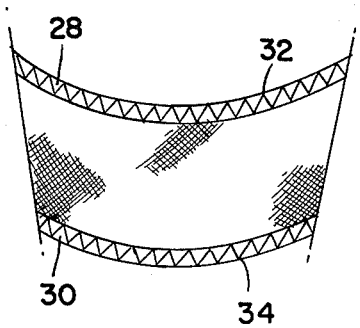
FIG. 3

PANTY HOSE GARMENTS

DESCRIPTION OF THE INVENTION

The present invention relates generally to ladies' panty hose of the type which includes an upper reinforced portion adapted to cover the lower trunk portion of the wearer to the waist, a pair of sheer and/or support stocking portions to cover the legs to slightly above the ankles with no covering portions for the feet.

Panty hose type garments have become increasingly popular because panty hose eliminates the need for stocking supporters, such as garter belts, garter fasteners and girdles. Therefore, panty hose have become very popular for wear with tight fitting clothing, such as slacks, since there are no garter fasteners to form objectionable bulges in clothing. However, because of the tightness or close fitting of the garment there is a reduction in the capacity of air drying and/or cooling of the feet which may cause or contribute to the discomfort of "athlete's foot". This would especially apply to the year around warm weather climates.

SUMMARY OF THE INVENTION

The primary objective of this invention is to provide a footless panty hose garment that will provide air and ventilation to the feet of the person wearing the garment.

Another objective in the invention is to provide a two-inch elastic band slightly above the ankle to eliminate the possible rising of the leg portion of the garment.

BRIEF DESCRIPTION OF THE DRAWINGS

FIG. 1 is a perspective view of the panty hose of the present invention.

FIG. 2 is an enlargement view of the two inch band at the bottom of the leg (ankle) portion.

FIG. 3 is enlargement view of the two inch band indicating necessary chainstitch covered by zigzag stitch.

DESCRIPTION OF THE PREFERRED EMBODIMENT

The panty hose of the present invention is generally designated by numeral 10 and includes leg encompassing stockings or stocking tubes 13 with upper portions 14 defining a panty garment and lower portions to the ankle. The stocking tubes 12 are constructed in a conventional manner and of conventional knitted elastic fabric material with an elastic waistband 18 being provided on the upper end of the panty hose. The two stocking tubes are connected together in a conventional manner along a center seam 20 which is continuous from the top edge of the panty hose at the front to the ventilated crotch insert 24 of oval shape to the top edge of the panty hose at the rear. Such panty hose structure are conventional and are constructed in a conventional manner and are associated with the wearer 22 in a conventional manner.

In order to provide ventilation to the feet of the wearer, the foot covering portion has been eliminated and the stocking tubes 12 will stop at the ankle with a two inch band 26 at the bottom of the leg encompassing stockings. The insert is constructed of conventional knitted elastic fabric material with an elastic band 26 superimposed over fabric secured at the point of termination by two parallel and spaced apart chain stitch seams 28 and 30 at the edge of the elastic band and two zigzag seams 32 and 34 covering said chain stitch seams. The elastic band 26 being provided at the bottom of the leg portion for ankle of the panty hose wearer, illustrated in FIGS. 2 and 3.

What is claimed as new is as follows:

1. A panty hose made of knitted fabric and comprising a lower trunk section and two leg sections, the fabric being knitted in 55–70 gauze and containing yarns in the 10–35 denier range, the leg sections terminating at a point between the knee and the ankle of a wearer, the point of termination being elastically secured to the leg of a wearer by an elastic hand, and the elastic band being superimposed over said fabric, secured at the point of termination by two parallel and spaced apart chain stick seams at the edges of said elastic band and two zigzag seams each covering said chainstitch seams to prevent raw edges of the fabric at said points of termination and said chain stiches from unravelling, both of said chainstitch and zigzag seams being simultaneously expandable and contractable with an expansion or contraction of said elastic band, respectively.

* * * * *